United States Patent [19]

Murata et al.

[11] 3,960,780

[45] June 1, 1976

[54] NON-CAKING ALKYL ETHER SULFATE-CONTAINING DETERGENT COMPOSITION

[75] Inventors: Moriyasu Murata, Chiba; Makoto Yamanaka, Koganei; Fumio Sai, Funabashi, all of Japan

[73] Assignee: Kao Soap Co., Ltd., Tokyo, Japan

[22] Filed: Oct. 31, 1975

[21] Appl. No.: 627,701

[30] Foreign Application Priority Data

Oct. 31, 1974 Japan ..... 49-125810

[52] U.S. Cl. ..... 252/532; 252/551; 252/384

[51] Int. Cl.[2] ..... C11D 1/14; C11D 17/06

[58] Field of Search ..... 252/532, 551, 384

[56] References Cited

UNITED STATES PATENTS

| | | | |
|---|---|---|---|
| 2,480,579 | 8/1949 | Holuba | 252/531 |
| 2,806,001 | 9/1957 | Fong et al. | 252/550 |
| 3,009,882 | 11/1961 | Clarke et al. | 252/116 |
| 3,801,511 | 4/1974 | Lemoff | 252/135 |
| 3,850,671 | 11/1974 | Watson | 252/384 X |
| 3,915,903 | 10/1975 | Wise | 252/552 |
| 3,920,586 | 11/1975 | Bonaparte et al. | 252/531 |

*Primary Examiner*—P.E. Willis, Jr.

*Attorney, Agent, or Firm*—Woodhams, Blanchard and Flynn

[57] ABSTRACT

A granular or powdery detergent composition comprising from 3 to 25% by weight of a surfactant selected from ether sulfates having the formulae (I) and (II):

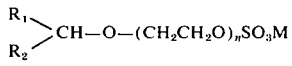

(I)

and

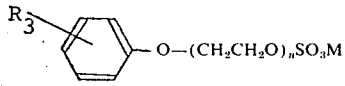

(II)

wherein $R_1$ and $R_2$ are hydrogen, alkyl having 1 to 21 carbon atoms or alkenyl having 1 to 21 carbon atoms, provided that the sum of the carbon atoms of $R_1$ and $R_2$ is 11 to 21, $R_3$ is alkyl having 8 to 16 carbon atoms, *n* is a number of 1 to 10, and M is an alkali metal or an alkaline earth metal, and 10 to 100% by weight, based on said ether sulfate, of a polyethylene glycol having a molecular weight of 2,000 to 50,000.

5 Claims, No Drawings

NON-CAKING ALKYL ETHER SULFATE-CONTAINING DETERGENT COMPOSITION

BACKGROUND OF THE INVENTION

1. Field of the Invention

This invention relates to an improvement in a granular or powdery detergent composition comprising an ether sulfate as a main component, whereby to reduce the tendency for said composition to cake or agglomerate.

2. Description of the Prior Art

The demand for sodium tripolyphosphate is increasing, but the supply thereof is not sufficient. Accordingly, it is now important to utilize sodium tripolyphosphate as effectively as possible. As a means for reducing the amount of sodium tripolyphosphate employed in detergents without decreasing the washing power of the detergents, there has been proposed a method according to which an ether sulfate having hard water resistance is employed as a detergent active ingredient. A granular or powdery detergent composition comprising an ether sulfate, however, is sticky and it has the disadvantage that caking readily occurs, although it possesses a sufficient washing effect.

Caking of a powdery or granular detergent composition causes difficulties not only during the detergent-manufacturing steps but also when it is actually used in households. Accordingly, this caking phenomenon drastically reduces the commercial value of powdery or granular detergent compositions. Therefore, it is very important to improve the anti-caking property of powdery or granular detergent compositions comprising an ether sulfate.

SUMMARY OF THE INVENTION

We have discovered that the anti-caking property of ether sulfate-containing detergent compositions can be unexpectedly improved by incorporating polyethylene glycols therein. This result is surprising because polyethylene glycols have not been known to have a caking-preventive activity.

More specifically, in accordance with this invention, there is provided a granular or powdery detergent composition comprising as critical components, from 3 to 25 % by weight, preferably from 5 to 15% by weight, of a detergent active ingredient selected from ether sulfates having the formulae (I) and (II):

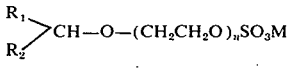

$$\begin{matrix} R_1 \\ R_2 \end{matrix}\!\!>CH-O-(CH_2CH_2O)_nSO_3M \qquad (I)$$

and

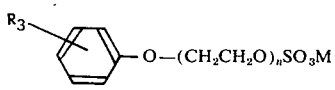

$$R_3-C_6H_4-O-(CH_2CH_2O)_nSO_3M \qquad (II)$$

wherein $R_1$ and $R_2$, which can be the same or different, are hydrogen, alkyl having 1 to 21 carbon atoms, or alkenyl group having 1 to 21 carbon atoms, provided that the sum of the numbers of carbon atoms of $R_1$ plus $R_2$ is 11 to 21, $R_3$ is alkyl having 8 to 16 carbon atoms, $n$ is a number of 1 to 10, and M is an alkali metal or an alkaline earth metal, and mixtures thereof and 10 to 100% by weight, based on the detergent active ether sulfate ingredient (I and/or II), of a polyethylene glycol having a molecular weight of 2,000 to 50,000. The polyethylene glycol is present as a uniformly distributed coating on, and/or as an inclusion in, the detergent particles, and it is not present as a simple blend of polyethylene glycol particles and detergent particles. This is achieved by dissolving or dispersing the polyethylene glycol in the aqueous slurry of the detergent ingredients, formed during the conventional detergent manufacturing procedure. As is well known, such slurries are dried by spray-drying, tumble drying, etc. to obtain a granular or powdery detergent composition. A flowable granular or powdery detergent composition can be obtained because of formation of adsorption complex of ether sulfate and polyethylene glycol.

The caking-preventive agent used in this invention is a polyethylene glycol having a molecular weight ranging from 2,000 to 50,000. Since the intended product is a granular or powdery detergent, the polyethylene glycol should be solid at room temperature and hence, it should have a molecular weight of at least 2,000. If a polyethylene glycol having a molecular weight higher than 50,000 is employed, it is difficult to disperse it in the detergent-forming slurry and so its caking preventive effect is insufficient. Improvement of the caking property can be attained when a powdery polyethylene glycol is intimately mixed with a powdery or granular detergent.

It is preferred that the caking-preventive agent of this invention is incorporated in an amount of about 10 to about 100% by weight, based on the detergent active ingredient represented by formula (I) and/or (II).

The composition of this invention can further comprise additional conventional components of clothes washing detergent compositions, such as those mentioned below, in addition to the alkylethoxy sulfate and polyethylene glycol, which are critical components. For example, there can be used conventional anionic and nonionic clothes-washing surfactants, such as alkylbenzene sulfonates containing an alkyl group having 10 to 16 carbon atoms, linear or branched alkyl sulfates having 11 to 18 carbon atoms on the average, $\alpha$-olefin sulfonates having 10 to 20 carbon atoms on the average, internal olefin sulfonates having in the molecule an olefin linkage and 10 to 22 carbon atoms, alkane sulfonates having 10 to 22 carbon atoms, polyoxyethylene alkyl ethers having an HLB value of 8 to 18, polyoxyethylene alkylaryl ethers having an HLB value of 8 to 18, polyoxyethylene fatty acid esters having an HLB value of 8 to 18, polyoxyethylene sorbitan fatty acid esters having an HLB value of 8 to 18, and mixtures of two or more of the foregoing compounds. It is preferred that anionic surface active agents be used in the form of salts of alkali metals such as sodium and potassium. The total amount of surfactants, that is, ether sulfate surfactant plus anionic or nonionic surfactant, is preferred to be in the range of 5 to 35 percent by weight. The amount of the anionic and/or nonionic surfactants can be from zero to 35 percent by weight, preferably from 5 to 25 percent by weight.

The balance of the detergent composition of this invention consists of any suitable conventional ingredients for clothes washing detergent compositions, or mixtures thereof, employed in the conventional amounts. For example, there can be used alkaline inorganic builder salts such as condensed phosphoric acid salts, for example, sodium tripolyphosphate and sodium pyrophosphate, as well as water-soluble organic builders such as nitrilotriacetates, citrates and other chelating builders. Moreover, the detergent composition of this invention can comprise other inorganic water-soluble alkaline builder salts customarily used for detergents for clothes, such as silicates, carbonates, water-soluble neutral salts such as Glauber's salt, carboxymethyl cellulose and the like. Still further, enzymes, oxygen-type bleaching agents, fluorescent dyes, bluing agents, perfumes and the like can be incorporated in the detergent composition of this invention. It is preferred that the detergent composition contains sodium tripolyphosphate in an amount in the range of 10 to 25 weight percent. Further, it is preferred that the detergent composition contains about 5 to 40 weight percent of Glauber's salt.

This invention will now be further described by reference to the following illustrative Examples.

Each of the samples used in these Examples was prepared and tested in the following manner:

A detergent slurry comprising 60% by weight of detergent components and 40% by weight of water was charged into a mixing tank of 10 cm in diameter and 12 cm in depth provided with a heating jacket. The slurry was mixed and agitated uniformly at 60°C and then was allowed to stand still for 15 minutes. The slurry was then dried at 60° to 80°C under reduced pressure in a vacuum drum drier until the water content was reduced to substantially zero. The resulting powdery detergent was sieved and particles of a size of 420 to 710 $\mu$ were recovered and allowed to stand still in a tank maintained at a temperature of 30°C and a relative humidity of 80% to adjust the water content to $9 \pm 1\%$ by weight, following which the detergent was tested.

The flowability of the detergent was tested according to the synthetic detergent test method JIS K-3362 using an apparent density-measuring device. More specifically, about 100 cc of the powdery detergent sample was allowed to fall under free gravity fall into a 100-cc capacity beaker disposed at the lower end of the density-measuring device, and the powdery detergent sample was precisely weighed. The thus-weighed powdery detergent powder (100 cc) was charged in a funnel of the measuring device and a damper disposed at the lower end of the funnel was opened. The time period from the time of opening of the damper to the time of completion of discharge of the entire sample was measured. The flowability is expressed by the thus-measured time. The flowability is higher as this time becomes shorter.

The breaking load was measured in the following manner:

1.5 g of the powdery detergent sample was charged into a cylinder of 1.5 cm in diameter, and an iron plate having a weight of 100 g was placed on the powdery detergent. Pressing was conducted for 3 minutes to obtain a tablet. Then, iron plates having a weight of 10 g were placed on the tablet one by one at intervals of 30 seconds. When the tablet became broken, the number of the iron plates previously placed on the tablet was counted. This test was conducted three times and the average value was calculated. The breaking load is expressed by the total weight (g) of the iron plates that caused the tablets to break. A higher breaking load indicates a higher stickiness of the detergent.

The caking property was determined in the following manner:

12.5 g of the sample was filled in a case formed of filter paper (7.4 cm × 4.4 cm × 2.8 cm (height)), and the sample was levelled. An iron plate having a size of 7.2 cm × 4.2 cm was placed on the sample, and in this state the sample was allowed to stand still in a thermostat tank maintained at a temperature of 30°C and a relative humidity of 80% for 7 days. Then, the powdery detergent was placed on a sieve of 4 mm × 4 mm mesh so as to be allowed to pass therethrough. The weight A (g) of the powder that remained on the sieve and the weight B (g) of the powder that passed through the sieve were measured. The passage ratio was calculated according to the following equation:

$$\text{Passage ratio } (\%) = \frac{B}{A+B} \times 100$$

A larger value of the passage ratio indicates a lower degree of caking.

EXAMPLE 1

According to the prescribed methods set forth above, a powder detergent having the following composition was prepared and its flowability, breaking load and passage ratio were determined.

| Detergent Composition | % by weight |
|---|---|
| detergent active component (sodium polyoxyethylene (3.4) linear $C_{14}$ alkyl ether sulfate (hereinafter referred to as "ES-1") or sodium linear dodecylbenzene sulfonate (hereinafter referred to as "LAS")) | as indicated in Table 1 |
| sodium tripolyphospate | 20 |
| sodium silicate | 10 |
| sodium carbonate | 5 |
| caking-preventive agent (polyethylene glycol having an average molecular weight 6,000 (hereinafter referred to as "PEG-6000"), polyvinyl alcohol having an average molecular weight of 15,000 (hereinafter referred to as "PVA-15000"), carboxymethyl cellulose (hereinafter referred to as "CMC"), sodium p-toluene sulfonate (hereinafter referred to as "PTS") or sodium sulfosuccinate (hereinafter referred to as "SS")) | as indicated in Table 1 |
| water | 8 |
| Glauber's salt | balance |
| total | 100 |

The test results are shown in Table 1.

Table 1

| Sample No. | Detergent Active Ingredient | | Caking-Preventive Agent | | | | | Flowability (sec) | Breaking Load (g) | Passage Ratio (%) |
|---|---|---|---|---|---|---|---|---|---|---|
| | ES-1 | LAS | PEG −6,000 | PVA −15,000 | CMC | PTS | SS | | | |
| 1 (this invention) | 15 | — | 1.5 | — | — | — | — | 12.3 | 60 | 70 |
| 2 (this invention) | 15 | — | 5 | — | — | — | — | 10.0 | 48 | 75 |

Table 1-continued

| Sample No. | Detergent Active Ingredient ES-1 | LAS | Caking-Preventive Agent PEG -6,000 | PVA -15,000 | CMC | PTS | SS | Flowability (sec) | Breaking Load (g) | Passage Ratio (%) |
|---|---|---|---|---|---|---|---|---|---|---|
| 3 (this invention) | 15 | — | 15 | — | — | — | — | 8.9 | 39 | 100 |
| 4 (this invention) | 5 | 15 | 0.5 | — | — | — | — | 12.9 | 58 | 79 |
| 5 (this invention) | 5 | 15 | 2.5 | — | — | — | — | 9.5 | 42 | 84 |
| 6 (comparison) | — | 20 | — | — | — | — | — | 9.0 | 35 | 96 |
| 7 (comparison) | 15 | — | — | — | — | — | — | no flow | 180 | 0 |
| 8 (comparison) | 15 | — | — | 5 | — | — | — | no flow | 200 | 0 |
| 9 (comparison) | 15 | — | — | — | 4 | — | — | no flow | 195 | 0 |
| 10 (comparison) | 5 | 15 | — | — | — | — | — | no flow | 150 | 5 |
| 11 (comparison) | 5 | 15 | — | 3 | — | — | — | no flow | 210 | 0 |
| 12 (comparison) | 5 | 15 | — | — | 2 | — | — | no flow | 205 | 2 |
| 13 (comparison) | 15 | — | 0.5 | — | — | — | — | 18.0 | 140 | 21 |
| 14 (comparison) | 5 | 15 | 0.2 | — | — | — | — | 17.8 | 120 | 35 |
| 15 (comparison) | 5 | 15 | — | — | — | 3 | — | no flow | 130 | 19 |
| 16 (comparison) | 5 | 15 | — | — | — | — | 4 | no flow | 145 | 23 |

As is seen from the data in Table 1, the physical properties of a detergent powder containing ES-1 are not improved by known conventional caking-preventive agents for LAS type detergents, such as PTS, SS and water-soluble polymeric substances, but they are effectively improved by incorporation of at least 10 wt.% of PEG, based on the weight of ES-1.

PEG 6000 was added to an aqueous solution of ether sulfate used in Example 1 so that a slurry containing 25 weight percent of ether sulfate and 25 weight percent of PEG could be prepared. The obtained slurry was dried in vacuum at 80°C for 3 days to obtain the solid A. Separately, the solid B not containing PEG was obtained in the same manner. Very flowable particles having 420 to 710 micron size could be obtained from the solid A. The solid B was paste and could not turn to particles. This fact is considered to explain that adsorption complex is formed between ether sulfate and PEG. Such phenomena will occur in flowable particles of a detergent composition, whereby caking of ether sulfate, which will cause caking of a detergent composition, is prevented. Furthermore, LAS (linear alkyl benzen sulfonate) and LAS-PEG were also subjected to the same procedure and it was found that very flowable particles of LAS was obtained and that LAS-PEG produced more flowable particles.

EXAMPLE 2 (COMPARISON)

The ES-1 detergent composition described in Example 1, except that it did not contain any caking-preventive agent, was powdered according to the method described in Example 1, and then a powder of the caking-preventive agent used in Example 1 was added to the resulting powder and they were mixed uniformly. Then, the flowability, breaking load and passage ratio of the remaining compositions were determined. It was found that none of the caking-preventive agents improves the physical properties of the detergent composition initially free of caking preventive agents.

EXAMPLE 3

According to the methods described above, a powdery detergent having the following composition was prepared and its flowability, breaking load and passage ratio were determined to examine the influences of the molecular weight of polyethylene glycol (PEG) on these physical properties.

| Detergent Composition | % by weight |
|---|---|
| ES-1 | 15 |
| sodium tripolyphosphate | 20 |
| sodium silicate | 10 |
| sodium carbonate | 5 |
| PEG | 5 |
| water | 8 |
| Glauber's salt | balance |
| total | 100 |

The results are shown in Table 2.

Table 2

| Sample No. | Molecular Weight of PEG | Flowability (sec) | Breaking Load (g) | Passage Ratio (%) |
|---|---|---|---|---|
| 17 (comparison) | 200 | no flow | 150 | 0 |
| 18 (comparison) | 400 | no flow | 134 | 0 |
| 19 (comparison) | 1000 | no flow | 105 | 40 |
| 20 (this invention) | 2000 | 12.0 | 58 | 70 |
| 21 (this invention) | 4000 | 10.9 | 49 | 73 |
| 22 (this invention) | 6000 | 10.0 | 48 | 75 |
| 23 (this invention) | 10000 | 9.9 | 42 | 80 |
| 24 (this invention) | 50000 | 12.0 | 60 | 70 |
| 25 (comparison) | 80000 | no flow | 103 | 23 |
| 26 (comparison) | 500000 | no flow | 110 | 15 |
| 27 (comparison) | 1000000 | no flow | 125 | 32 |

From data shown in Table 2, it is seen that PEG has a caking-preventive effect when PEG having a molecular weight of from 2,000 to 50,000 is used. When the molecular weight is lower than 2,000, PEG is not solid at room temperature or at temperatures approximating room temperature. When the molecular weight is higher than 50,000, PEG is not dispersed uniformly in the detergent slurry. It is considered that for these reasons, PEG having a molecular weight below 2,000 or above 50,000 will not exhibit a caking-preventive effect.

EXAMPLE 4

According to the prescribed methods, various powdery detergents having the compositions indicated in Table 3 were prepared and tested with respect to their flowability, breaking load and passage ratio.

The compositions of the detergents and test results are shown in Table 3.

Table 3

| Components of Detergent Composition | Sample No. 28 | Sample No. 29 | Sample No. 30 | Sample No. 31 | Sample No. 32 | Sample No. 33 | Sample No. 34 |
|---|---|---|---|---|---|---|---|
| ES-1 | 10 | 10 | 2 | 2 | — | — | 8 |
| polyoxyethylene(2.8) oxoalkyl($C_{14.5}$) sodium ether sulfate | — | — | — | — | 8 | 8 | — |
| sodium polyoxyethylene (3) sec-alkyl ($C_{14.5}$) ether sulfate | — | — | — | — | — | — | — |
| sodium polyoxyethylene (3) nonylphenyl ether sulfate | — | — | | | | | |
| LAS | — | — | 13 | 13 | — | — | — |
| sodium oxoalcohol (average molecular weight = 205) sulfate | 10 | 10 | — | — | — | — | — |
| sodium olefin sulfonate (α-olefin/internal olefin = 20/80;$C_{16.2}$) | — | — | 5 | 5 | 12 | 12 | — |
| sodium alkane sulfonate (average molecular weight = 319) | — | — | — | — | — | — | 12 |
| sodium vinylidene type olefin sulfonate ($C_{16}$) | — | — | — | — | — | — | — |
| polyoxyethylene (8.4) decyl ether | — | — | — | — | — | — | — |
| sodium tripolyphosphate | 20 | 20 | 18 | 18 | 22 | 22 | 18 |
| sodium silicate | 13 | 13 | 13 | 13 | 10 | 10 | 8 |
| sodium carbonate | 5 | 5 | 5 | 5 | 3 | 3 | 5 |
| CMC | 1 | 1 | 1 | 1 | — | — | 1 |
| PEG - 6,000 | 4 | — | 2 | — | 5 | — | 1 |
| water | 10 | 10 | 10 | 10 | 10 | 10 | 8 |
| Glauber's salt | balance | balance | balance | balance | balance | balance | balance |
| Physical Properties of Detergent Powder | | | | | | | |
| Flowability(sec) | 11.5 | no flow | 10.8 | 18 | 10.3 | no flow | 15 |
| Breaking Load (g) | 42 | 171 | 41 | 125 | 45 | 182 | 52 |
| Passage Ratio(%) | 72 | 10 | 95 | 21 | 79 | 15 | 70 |

| Components of Detergent Composition | Sample No. 35 | Sample No. 36 | Sample No. 37 | Sample No. 38 | Sample No. 39 | Sample No.40 | Sample No. 41 |
|---|---|---|---|---|---|---|---|
| ES-1 | 8 | 8 | 8 | — | — | — | — |
| polyoxyethylene (2.8) oxoalkyl ($C_{14.5}$) sodium ether sulfate | — | — | — | — | — | — | — |
| sodium polyoxyethylene (3) sec-alkyl ($C_{14.5}$) ether sulfate | — | — | — | 3 | 3 | — | — |
| sodium polyoxyethylene (3) nonylphenyl ether sulfate | — | — | — | — | — | 5 | 5 |
| LAS | — | — | — | 25 | 25 | 17 | 17 |
| sodium oxoalcohol (average molecular weight = 205) sulfate | — | — | — | — | — | — | — |
| sodium olefin sulfonate (α-olefin/internal olefin = 20/80;$C_{16.2}$) | — | 3 | 3 | — | — | — | — |
| sodium alkane sulfonate (average molecular weight = 319) | 12 | — | — | — | — | — | — |
| sodium vinylidene type olefin sulfonate ($C_{16}$) | — | 7 | 7 | — | — | — | — |
| polyoxyethylene (8.4) decyl ether | — | — | — | 2 | 2 | — | — |
| sodium tripolyphosphate | 18 | 10 | 10 | 20 | 20 | 25 | 25 |
| sodium silicate | 8 | 8 | 8 | 10 | 10 | 10 | 10 |
| sodium carbonate | 5 | 5 | 5 | 5 | 5 | 5 | 5 |
| CMC | 1 | 1 | 1 | 1 | 1 | 1 | 1 |
| PEG - 6,000 | — | 5 | — | 2 | — | 3 | — |
| water | 8 | 5 | 5 | 8 | 8 | 10 | 10 |
| Glauber's salt | balance | balance | balance | balance | balance | balance | balance |
| Physical Properties of Detergent Powder | | | | | | | |
| flowability (sec) | no flow | 20 | no flow | 14.5 | no flow | 10.5 | no flow |
| Breaking Load (g) | 192 | 80 | no breaking | 65 | 215 | 44 | 170 |
| Passage Ratio (%) | 13 | 60 | 0 | 69 | 0 | 73 | 18 |

In Table 3, samples Nos. 28 and 29, 30 and 31, . . . 40 and 41 are paired, and samples of even numbers are those of this invention and samples of odd numbers are comparative samples.

As is seen from the data shown in Table 3, the powder characteristics of ES-containing detergents having poor powder physical properties can be highly improved by incorporation of PEG-6000.

The embodiments of the invention in which an exclusive property or privilege is claimed are defined as follows:

1. A granular or powdery detergent composition consisting essentially of from 3 to 25 percent by weight of an ether sulfate surfactant selected from the group consisting of compounds having the formulae

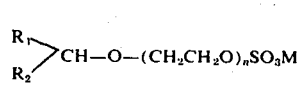

and

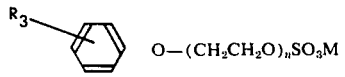

and mixtures thereof, wherein $R_1$ and $R_2$, which are the same or different, are hydrogen, alkyl having one to 21 carbon atoms, or alkenyl having one to 21 carbon atoms, provided that the sum of the number of carbon atoms of $R_1$ plus $R_2$ is 11 to 21, $R_3$ is alkyl having 8 to 16 carbon atoms,

*n* is a number from 1 to 10, and

M is an alkali metal or an alkaline earth metal, from 10 to 100 percent by weight, based on the weight of said ether sulfate surfactant, of polyethylene glycol having a molecular weight of 2000 to 50000, and the balance is water-soluble, synthetic anionic clothes-washing surfactant, different from said ether sulfate, or water-soluble, synthetic nonionic clothes washing surfactant, or water-soluble alkaline inorganic builder salt, or water-soluble organic builder, or water-soluble neutral salt, or mixtures thereof, said detergent composition having been prepared by mixing the above-named components thereof with water to form a uniform slurry, and then removing water from the slurry to obtain the powdery detergent composition having the polyethylene glycol uniformly distributed on the detergent particles.

2. A detergent composition as claimed in claim 1, in which the content of said ether sulfate surfactant is from 5 to 15 percent by weight.

3. A detergent composition as claimed in claim 1, containing from 5 to 25 percent by weight of water-soluble synthetic anionic surfactant different from said ether sulfate, water-soluble synthetic nonionic clothes washing surfactant, or mixtures thereof, and from 5 to 15 percent by weight of said ether sulfate surfactant.

4. A detergent composition as claimed in claim 1, in which the molecular weight of said polyethylene glycol is from 4,000 to 10000.

5. A detergent composition as claimed in claim 1, containing from 10 to 25 percent by weight of sodium tripolyphosphate and from 5 to 40 percent by weight of Glauber's salt.

* * * * *